US009410292B2

(12) United States Patent
Lindsay et al.

(10) Patent No.: US 9,410,292 B2
(45) Date of Patent: Aug. 9, 2016

(54) MULTILAYERED TISSUE HAVING REDUCED HYDROGEN BONDING

(71) Applicant: Kimberly-Clark Worldwide, Inc., Neenah, WI (US)

(72) Inventors: Stephen Michael Lindsay, Appleton, WI (US); Michael Andrew Zawadzki, Appleton, WI (US); Jian Qin, Appleton, WI (US); Mike Thomas Goulet, Neenah, WI (US); Cathleen Mae Uttecht, Menasha, WI (US); Donald Eugene Waldroup, Roswell, GA (US); Deborah Joy Calewarts, Appleton, WI (US); Kenneth John Zwick, Neenah, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 14/416,504

(22) PCT Filed: Dec. 20, 2013

(86) PCT No.: PCT/US2013/076880
§ 371 (c)(1),
(2) Date: Jan. 22, 2015

(87) PCT Pub. No.: WO2014/105691
PCT Pub. Date: Jul. 3, 2014

(65) Prior Publication Data

US 2015/0176222 A1 Jun. 25, 2015

Related U.S. Application Data

(63) Continuation-in-part of application No. 13/726,938, filed on Dec. 26, 2012, now Pat. No. 8,980,054.

(51) Int. Cl.

| | |
|---|---|
| ***D21H 27/40*** | (2006.01) |
| ***D21H 27/00*** | (2006.01) |
| ***D21H 21/22*** | (2006.01) |
| ***D21H 27/38*** | (2006.01) |
| ***D21C 9/00*** | (2006.01) |
| ***D21H 11/16*** | (2006.01) |

(52) U.S. Cl.
CPC ..... *D21H 27/40* (2013.01); *D21C 9/005* (2013.01); *D21H 11/16* (2013.01); *D21H 21/22* (2013.01); *D21H 27/002* (2013.01); *D21H 27/005* (2013.01); *D21H 27/38* (2013.01)

(58) Field of Classification Search
USPC ..... 162/146, 157.6, 158, 161.1, 164.6, 183, 162/185; 8/181, 189, 190
See application file for complete search history.

(56) References Cited

U.S. PATENT DOCUMENTS

| | | | | |
|---|---|---|---|---|
| 2,306,440 | A | 12/1942 | Winfrid et al. | |
| 2,524,399 | A | 10/1950 | Schoene et al. | |
| 2,892,674 | A | 6/1959 | Robert et al. | |
| 3,124,414 | A | 3/1964 | Dolmetsch | |
| 3,240,797 | A | 3/1966 | Gale | |
| 3,961,892 | A | 6/1976 | Bishop et al. | |
| 3,994,771 | A | 11/1976 | Morgan, Jr. et al. | |
| 4,035,146 | A | 7/1977 | Brenner et al. | |
| 4,166,001 | A | 8/1979 | Bicho et al. | |
| 4,186,238 | A | 1/1980 | Holst et al. | |
| 4,225,382 | A | 9/1980 | Kearney et al. | |
| 4,300,981 | A | 11/1981 | Carstens | |
| 4,372,815 | A | 2/1983 | Newkirk et al. | |
| 4,432,833 | A | 2/1984 | Breese | |
| 4,549,011 | A | 10/1985 | Herzberg et al. | |
| 5,397,435 | A | 3/1995 | Ostendorf et al. | |
| 5,494,554 | A * | 2/1996 | Edwards | D21F 11/04 162/111 |
| 5,580,354 | A | 12/1996 | Taylor | |
| 5,776,394 | A | 7/1998 | Schrott et al. | |
| 5,882,356 | A | 3/1999 | Potter et al. | |
| 5,935,383 | A | 8/1999 | Sun et al. | |
| 6,036,731 | A | 3/2000 | Scheibli et al. | |
| 6,162,327 | A | 12/2000 | Batra et al. | |
| 6,203,746 | B1 | 3/2001 | Aeschlimann et al. | |
| 6,328,850 | B1 | 12/2001 | Phan et al. | |

(Continued)

FOREIGN PATENT DOCUMENTS

| | | |
|---|---|---|
| EP | 0 404 189 A1 | 12/1990 |
| EP | 0 440 472 A1 | 8/1991 |

(Continued)

OTHER PUBLICATIONS

Smook, Gary A., Handbook for Pulp and Paper Technologists, 2nd ed, Angus Wilde Publications, 1992, pp. 250-253.*

Co-pending U.S. Appl. No. 14/359,833, filed Dec. 20, 2013, by Lindsay et al. for "Modified Cellulosic Fibers Having Reduced Hydrogen Bonding."

Sampson, W.W., "Materials Properties of Paper As Influenced by Its Fibrous Architecture," International Materials Reviews, vol. 54, No. 3, 2009, pp. 134-156.

*Primary Examiner* — Dennis Cordray
(74) *Attorney, Agent, or Firm* — Kimberly-Clark Worldwide, Inc.

(57) ABSTRACT

The disclosure provides a multilayered tissue web comprising treated cellulosic fibers selectively disposed in one or more layers, wherein the tissue layer comprising treated fibers is adjacent to a layer comprising untreated fiber and which is substantially free from untreated fiber. Generally the treated fibers have a rate of substitution of about 0.02 to 0.07. In this manner, the disclosure provides a multi-layered tissue web having treated fiber selectively incorporated therein, where the tissue web has basis weight greater than about 10 grams per square meter (gsm), such as from about 10 to about 50 gsm, a sheet bulk greater than about 8 cc/g, such as from about 8 to about 15 cc/g and Stiffness Index less than about 15, such as from about 8 to about 12.

20 Claims, No Drawings

(56) References Cited

U.S. PATENT DOCUMENTS

| | | | |
|---|---|---|---|
| 7,867,361 | B2 | 1/2011 | Salaam et al. |
| 7,972,474 | B2 | 7/2011 | Underhill et al. |
| 8,177,859 | B2 | 5/2012 | Schmidt et al. |
| 8,980,054 | B2 | 3/2015 | Yang et al. |
| 2001/0018308 | A1 | 8/2001 | Quick et al. |
| 2002/0037410 | A1 | 3/2002 | Criegee et al. |
| 2002/0096287 | A1 | 7/2002 | Jewell et al. |
| 2002/0112830 | A1 | 8/2002 | Bakken et al. |
| 2002/0195215 | A1 | 12/2002 | Holz et al. |
| 2003/0111196 | A1 | 6/2003 | Hu |
| 2003/0131960 | A1 | 7/2003 | McConnell et al. |
| 2005/0006039 | A1 | 1/2005 | Farrington et al. |
| 2005/0241791 | A1 | 11/2005 | Wolkowicz et al. |
| 2005/0252626 | A1 | 11/2005 | Chen et al. |
| 2008/0014428 | A1 | 1/2008 | Vinson et al. |
| 2014/0174686 | A1 | 6/2014 | Yang et al. |

FOREIGN PATENT DOCUMENTS

| | | | |
|---|---|---|---|
| EP | 0 777 783 | B1 | 3/2000 |
| EP | 0 951 603 | B1 | 8/2002 |
| EP | 0 939 844 | B1 | 11/2005 |
| JP | 2001-355183 | A | 12/2001 |
| WO | WO 85/04200 | A1 | 9/1985 |
| WO | WO 98/24974 | A1 | 6/1998 |
| WO | WO 99/36620 | A1 | 7/1999 |
| WO | WO 01/23660 | A1 | 4/2001 |
| WO | WO 02/14606 | A2 | 2/2002 |
| WO | WO 2005/123699 | A1 | 12/2005 |
| WO | WO 2009/017288 | A1 | 2/2009 |

* cited by examiner

MULTILAYERED TISSUE HAVING REDUCED HYDROGEN BONDING

RELATED APPLICATIONS

The present application is a national-phase entry, under 35 U.S.C. §371, of PCT Patent Application No. PCT/US2013/076880, filed on Dec. 20, 2013, which is a continuation-in-part application of U.S. patent application Ser. No. 13/726,938, filed on Dec. 26, 2012, both of which are incorporated herein by reference in a manner consistent with the instant application.

BACKGROUND

In the manufacture of paper products, such as facial tissue, bath tissue, paper towels, dinner napkins, and the like, a wide variety of product properties are imparted to the final product through the use of chemical additives applied in the wet end of the tissue making process. Two of the most important attributes imparted to tissue through the use of wet end chemical additives are strength and softness. Specifically for softness, a chemical debonding agent is normally used. Such debonding agents are typically quaternary ammonium compounds containing long chain alkyl groups. The cationic quaternary ammonium entity allows for the material to be retained on the cellulose via ionic bonding to anionic groups on the cellulose fibers. The long chain alkyl groups provide softness to the tissue sheet by disrupting fiber-to-fiber hydrogen bonds in the sheet. The use of such debonding agents is broadly taught in the art. Such disruption of fiber-to-fiber bonds provides a two-fold purpose in increasing the softness of the tissue. First, the reduction in hydrogen bonding produces a reduction in tensile strength thereby reducing the stiffness of the sheet. Secondly, the debonded fibers provide a surface nap to the tissue web enhancing the "fuzziness" of the tissue sheet. This sheet fuzziness may also be created through use of creping as well, where sufficient interfiber bonds are broken at the outer tissue surface to provide a plethora of free fiber ends on the tissue surface. Both debonding and creping increase levels of lint and slough in the product. Indeed, while softness increases, it is at the expense of an increase in lint and slough in the tissue relative to an untreated control. It can also be shown that in a blended (non-layered) sheet the level of lint and slough is inversely proportional to the tensile strength of the sheet. Lint and slough can generally be defined as the tendency of the fibers in the paper web to be rubbed from the web when handled.

It is also broadly known in the art to use a multi-layered tissue structure to enhance the softness of the tissue sheet. In this embodiment, a thin layer of strong softwood fibers is used in the center layer to provide the necessary tensile strength for the product. The outer layers of such structures are composed of the shorter hardwood fibers, which may or may not contain a chemical debonder. A disadvantage to using layered structures is that while softness is increased the mechanism for such increase is believed to be due to an increase in the surface nap of the debonded, shorter fibers. As a consequence, such structures, while showing enhanced softness, do so with a trade-off in the level of lint and slough.

It is also broadly known in the art to concurrently add a chemical strength agent in the wet-end to counteract the negative effects of the debonding agents. In a blended sheet, the addition of such agents reduces lint and slough levels. However, such reduction is done at the expense of surface feel and overall softness and becomes primarily a function of sheet tensile strength. In a layered sheet, strength chemicals are added preferentially to the center layer. While this perhaps helps to give a sheet with an improved surface feel at a given tensile strength, such structures actually exhibit higher slough and lint at a given tensile strength, with the level of debonder in the outer layer being directly proportional to the increase in lint and slough.

There are additional disadvantages with using separate strength and softness chemical additives. Particularly relevant to lint and slough generation is the manner in which the softness additives distribute themselves upon the fibers. Bleached Kraft fibers typically contain only about 2-3 milliequivalents of anionic carboxyl groups per 100 grams of fiber. When the cationic debonder is added to the fibers, even in a perfectly mixed system where the debonder will distribute in a true normal distribution, some portion of the fibers will be completely debonded. These fibers have very little affinity for other fibers in the web and therefore are easily lost from the surface when the web is subjected to an abrading force.

SUMMARY

It has now been surprisingly discovered that the sheet bulk of a tissue web may be increased, with little or no degradation in tensile strength, by forming the web with at least a portion of cellulosic fiber that has been reacted with a water soluble cellulose reactive agent such as a cyanuric halide or a vinyl sulfone and then selectively disposing the treated fiber in one or more layers of a multi-layered tissue web. Reacting cellulosic fiber with a water soluble cellulose reactive agent such as a cyanuric halide or a vinyl sulfone results in a treated fiber having fewer hydroxyl groups available to participate in hydrogen bonding when the web is formed. When the treated fiber is selectively incorporated into one or more layers of a multi-layered web, and more specifically the middle layer of a three layered web, the reduced hydrogen bonding results in a bulkier web that is also softer and less stiff.

Accordingly, in one embodiment the present invention provides a method of increasing the bulk of a tissue web comprising the steps of preparing a treated fiber by reacting cellulosic fiber with a cellulosic reactive reagent selected from the group consisting of a cyanuric halide having the general Formula (I):

(I)

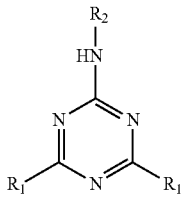

where $R_1$ equals F, Cl, Br, or I and $R_2$ equals $(CH_2)_n$—OH (n=1-3), $(CH_2)_n$—COOH (n=1-3), $C_6H_5$—COOH, or $HSO_3X$ where X equals $(CH_2)_n$ (n=1-3) or $C_6H_4$.

In other embodiments the present invention provides a method of increasing the bulk of a tissue web comprising the steps of preparing a treated fiber by reacting cellulosic fiber with a cellulosic reactive reagent having the Formula (II) and salts thereof:

(Formula II)

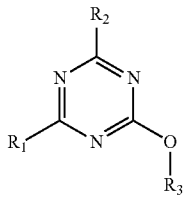

where $R_1$ and $R_2$ equal halogen, such as Cl, a quaternary ammonium group or an activated alkene and $R_3$ equals hydrogen or a metal cation, such as a sodium cation. Suitable quaternary ammonium groups include, for example, 4-m-carboxypyridinium and pyridinium. Suitable activated alkenes include, for example, alkenes having the general formula —NH—$C_6H_4$—$SO_2CH_2CH_2L$, where L is a leaving group selected from the group consisting of a halogen, —$OSO_3H$, —$SSO_3H$, —$OPO_3H$ and salts thereof.

In still other embodiments the treated fiber may be created by reacting cellulosic fiber with a vinyl sulfone having the general Formula (III):

(III)

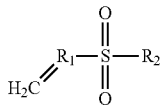

where $R_1$ equals a hydrocarbon having from about 1 to about 5 carbon atoms and $R_2$ equals $CH_3$, HC═$CH_2$, $(CH_2)_n$—$CH_3$ (n=1-3), $(CH_2)_n$—COOH (n=1-3), $C_6H_4$—COOH, or $C_6H_5$.

In yet other embodiments the treated fiber may be created by reacting cellulosic fiber with a water soluble cellulosic reactive compound having the general Formula (IV):

(IV)

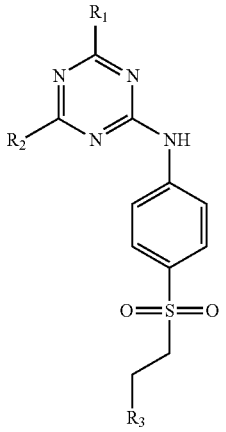

where $R_1$ equals F, Cl, Br, I or —OH, $R_2$ equals F, Cl, Br, I or —OH and $R_3$ equals —$OSO_3$— and salts thereof, —$SSO_3$— and salts thereof, phosphoric acid and salts thereof, or a halide.

In one embodiment reaction of the fiber with one of the foregoing reagents is carried out in the presence of a caustic agent, followed by washing the cellulosic fiber with water or the like to yield a treated fiber. The treated fiber may then be used to form a multi-layered tissue web from the treated cellulosic fiber by selectively incorporating the treated fiber in only one layer of the multi-layered tissue web, wherein the tissue web has a basis weight greater than about 10 grams per square meter (gsm), such as from about 10 to about 50 gsm and a sheet bulk greater than about 8 cc/g and more preferably greater than about 10 cc/g, such as from about 8 to about 20 cc/g.

In other embodiments treated fibers are selectively incorporated into one or more layers of a multilayered tissue web to increase bulk and reduce stiffness without a significant reduction in tensile strength. Accordingly, in one preferred embodiment the present disclosure provides a multilayered tissue web comprising treated fibers selectively disposed in one or more layers, wherein the tissue layer comprising treated fibers is adjacent to a layer comprising untreated fiber and which is substantially free from untreated fiber. Generally the treated fibers have a rate of substitution of about 0.02 to 0.07. In this manner, the disclosure provides a multi-layered tissue web having treated fiber selectively incorporated therein, where the tissue web has basis weight greater than about 10 grams per square meter (gsm), such as from about 10 to about 50 gsm, a sheet bulk greater than about 8 cc/g, such as from about 8 to about 15 cc/g and Stiffness Index less than about 15, such as from about 8 to about 12. Tissue webs prepared in this manner generally have geometric mean tensile (GMT) sufficient to maintain integrity of the web in use, such as greater than about 500 g/3" and in a particularly preferred embodiment from about 500 to about 800 g/3".

In still other embodiments the disclosure provides a multi-layered tissue web comprising a first, second and third layer, where the second layer comprises modified wood pulp fibers having a nitrogen content greater than about 0.2 weight percent, and the first and third layers comprise untreated conventional cellulosic fibers, where the tissue web has a basis weight from about 10 to about 50 gsm and a sheet bulk greater than about 8 cc/g. In a particularly preferred embodiment the first and third layers are substantially free of modified wood pulp fibers.

In another embodiment the present invention provides a multi-layered tissue web comprising a first, second and third layer, where the second layer comprises modified wood pulp fibers having a nitrogen content greater than about 0.2 weight percent, and the first and third layers comprise untreated conventional cellulosic fibers, where the tissue web has a basis weight from about 10 to about 50 gsm and a sheet bulk greater than about 8 cc/g. In a particularly preferred embodiment the first and third layers are substantially free of modified wood pulp fibers.

In still other embodiments the present invention provides a multi-layered tissue web comprising a first, second and third layer, where the second layer comprises modified wood pulp fibers having a sulfur content greater than about 0.5 weight percent, and the first and third layers comprise untreated conventional cellulosic fibers, where the tissue web has a basis weight from about 10 to about 50 gsm and a sheet bulk greater than about 8 cc/g.

Other features and aspects of the present invention are discussed in greater detail below.

DEFINITIONS

As used herein the terms "treated fiber" refer to any cellulosic fibrous material that has been reacted with a cellulosic reactive reagent selected from a group consisting of reagents having the general Formula (I), (II), (III) and (IV).

As used herein, the term "tissue product" refers to products made from tissue webs and includes, bath tissues, facial tissues, paper towels, industrial wipers, foodservice wipers, napkins, medical pads, and other similar products. Tissue products may comprise one, two, three or more plies.

As used herein, the terms "tissue web" and "tissue sheet" refer to a fibrous sheet material suitable for forming a tissue product.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "geometric mean tensile" (GMT) refers to the square root of the product of the machine direction tensile and the cross-machine direction tensile of the web, which are determined as described in the Test Method section.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight (gsm). The resulting sheet bulk is expressed in cubic centimeters per gram (cc/g).

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "geometric mean slope" (GM Slope) generally refers to the square root of the product of machine direction slope and cross-machine direction slope. GM Slope generally is expressed in units of kg/3" or g/3".

As used herein, the term "Stiffness Index" refers to the quotient of the geometric mean slope (having units of g/3") divided by the geometric mean tensile strength (having units of g/3").

As used herein the term "substantially free" refers to a layer of a tissue that has not been formed with the addition of treated fiber. Nonetheless, a layer that is substantially free of treated fiber may include de minimus amounts of treated fiber that arise from the inclusion of treated fibers in adjacent layers and do not substantially affect the softness or other physical characteristics of the tissue web.

As used herein the term "substitution rate" refers to as the mols of chemical added per mol of glucose units in the cellulose. For cellulose fibers reacted with a nitrogen containing reactive agent, substitution rate may be calculated as:

$$SR = \frac{MW_{cell}}{\frac{MW_N \cdot z}{N_f} + MW_H - MW_{chem}}$$

Based upon the nitrogen fraction of the final reacted and washed pulp ($N_f$), molecular weight of a glucose unit in cellulose ($MW_{cell}$=162.1 g/mol), MW of the reactive agent bonded to the cellulose, MW of nitrogen (14.007), and MW of hydrogen (1.008). Generally the substation rate ranges from about 0.02 to 0.07.

DETAILED DESCRIPTION

The present invention provides a modified cellulosic fiber having reduced hydrogen bonding capabilities. The treated fiber formed in accordance with the present invention may be useful in the production of tissue products having improved bulk and softness. More importantly, the treated fiber is adaptable to current tissue making processes and may be incorporated into a tissue product to improve bulk and softness without an unsatisfactory reduction in tensile. The cellulosic fiber formed in accordance with the invention is modified cellulosic fiber that has been reacted with a cellulosic reactive reagent such that the rate of substitution is from about 0.02 to about 0.07. In particularly preferred embodiments the cellulosic reactive reagent is selected from the group consisting of reagents having the general Formula (I), (II), (III) and (IV).

A decreased ability to hydrogen bond is imparted to the cellulosic fiber through reaction of the cellulosic fiber hydroxyl functional groups with the cellulosic reactive reagent, which impedes the hydroxyl functional groups from participating in hydrogen bonding with one. Preferably the number of hydroxyl groups reacted on each cellulosic fiber are sufficient to impede hydrogen bonding to a degree sufficient to enhance bulk and softness.

Compared to commercially available tissue products, tissue products prepared according to the present disclosure are generally less stiff (measured as Stiffness Index) and have higher bulk, as illustrated in the table below.

TABLE 1

| Sample | Sheet Bulk (cc/g) | GMT (g/3") | GM Slope (kg/3") | Stiffness Index |
|---|---|---|---|---|
| Kleenex ® Mainline Facial Tissue | 6.1 | 810 | 9.82 | 12.12 |
| Puffs Basic ® Facial Tissue | 9.1 | 689 | 8.28 | 12.02 |
| Puffs Plus ® Facial Tissue | 7.3 | 852 | 11.63 | 13.65 |
| Puffs Ultra Strong and Soft ® Facial Tissue | 6.9 | 980 | 13.76 | 14.04 |
| Publix ® Facial Tissue | 5.9 | 835 | 11.86 | 14.20 |
| Up & Up ™ Everyday Facial Tissue | 5.5 | 870 | 12.09 | 13.90 |
| Scotties ® 3-Ply Facial Tissue | 5.1 | 1212 | 18.16 | 14.98 |
| Inventive Sample | 9.5 | 775 | 7.76 | 10.01 |
| Inventive Sample | 8.9 | 586 | 6.41 | 10.94 |

Unexpectedly the increase in bulk and decrease in stiffness is most acute when the treated fibers are selectively incorporated into a single layer of a multi-layered web, and particularly the middle layer of a three layered web. Webs produced in this manner not only display a surprising increase in bulk, but also produce webs having reduced stiffness without a significant deterioration in strength. Typically adding treated fibers to the center layer would decrease bonding and significantly decrease strength. To lessen this effect, one skilled in art would typically blend or add treated fibers to the outer layers. Here however, the most beneficial use of treated fibers is in the middle layer of a multi-layered web.

Although based upon their inability to participate in hydrogen bonding the treated fibers would not appear to be a suitable replacement for wood fibers, and particularly softwood fibers that customarily constitute a large percentage of the center layer of a multi-layered tissue web, it has now been discovered that by selectively incorporating treated fibers into a multi-layered web, even in amounts up to 100 percent by weight of the center layer, these negative effects may be minimized. Even more surprising is that treated hardwood pulp fibers may be used in the middle-layer of a multi-layered web without a deleterious effect.

Accordingly, in one embodiment the present disclosure provides a multilayered tissue web comprising treated fibers selectively disposed in one or more layers, wherein the tissue layer comprising treated fibers is adjacent to a layer comprising untreated fiber and which is substantially free from untreated fiber. In a particularly preferred embodiment the web comprises three layers where treated fibers are disposed in the middle layer and the first and third layers are substantially free from treated fibers. However, it should be understood that the tissue product can include any number of plies or layers and can be made from various types of pulp and treated fibers. The tissue webs may be incorporated into tissue products that may be either single or multi-ply, where one or more of the plies may be formed by a multi-layered tissue web having cotton selectively incorporated in one of its layers.

Regardless of the exact construction of the tissue product, at least one layer of a multi-layered tissue web incorporated into the tissue product comprises treated fibers, while at least one layer comprises untreated conventional cellulosic fibers. Conventional cellulosic fibers may comprise wood pulp fibers formed by a variety of pulping processes, such as kraft pulp, sulfite pulp, thermomechanical pulp, etc. Further, the wood fibers may have any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood fibers include hardwood fibers, such as, but not limited to, eucalyptus, maple, birch, aspen, and the like, which can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste.

In addition to conventional cellulosic fibers the tissue web comprises treated fibers, which are selectively incorporated into one or more layers of the multi-layered tissue web to help increase softness in the resulting tissue product. In one particular embodiment, the treated fibers are treated wood pulp fibers. In one embodiment hardwood pulp fibers modified with a cellulosic reactive reagent selected from a group consisting of reagents having the general Formula (I), (II), (III) and (IV) are utilized in the formation of tissue products to enhance their bulk and softness. In one particular embodiment, water soluble cyanuric halide modified hardwood pulp fibers, and more particularly modified eucalyptus kraft pulp fibers, are incorporated into a multi-layered web having a first layer comprising a blend of modified and unmodified hardwood kraft fibers and a second layer comprising softwood fiber. In such embodiments the treated fiber may be added to the first layer, such that the first layer comprises greater than about 2 percent, by weight of the layer, treated fiber, such as from about 2 to about 40 percent and more preferably from about 5 to about 30 percent.

The chemical composition of the treated fiber of the invention depends, in part, on the extent of processing of the cellulosic fiber from which the treated fiber is derived. In general, the treated fiber of the invention is derived from a fiber that has been subjected to a pulping process (i.e., a pulp fiber). Pulp fibers are produced by pulping processes that seek to separate cellulose from lignin and hemicellulose leaving the cellulose in fiber form. The amount of lignin and hemicellulose remaining in a pulp fiber after pulping will depend on the nature and extent of the pulping process. Thus, in certain embodiments the invention provides a treated fiber comprising lignin, cellulose, hemicellulose and a covalently bonded cyanuric halide.

Generally after reaction of the cellulosic reactive reagent and the pulp hydroxyl functional groups unreacted reagent is removed by washing. After washing, the extent of reaction between the pulp hydroxyl function groups and the water soluble reagent may be assessed by nitrogen elemental analysis in the case of a cyanuric halide reagent or sulfur elemental analysis in the case of a vinyl sulfone reagent of the modified pulp, with higher amounts of nitrogen or sulfur indicating a greater extent of reaction. Accordingly, in one embodiment the present disclosure provides preparing a treated fiber by reacting cellulosic fiber with a nitrogen containing cellulosic reactive agent having the general formula (I), (II), or (IV) where the treated fiber has a nitrogen content from about 0.05 to about 5 weight percent and more preferably from about 0.1 to about 3 weight percent. In other embodiments the present disclosure provides preparing a treated fiber by reacting cellulosic fiber with a sulfur containing cellulosic reactive agent having the general formula (III) where the treated fiber has a sulfur content from about 0.05 to about 5 weight percent and more preferably from about 0.1 to about 3 weight percent.

In one embodiment the treated fiber comprises a cellulosic fiber that has been reacted with a halogen atom attached to a polyazine ring, for example fluorine, chlorine or bromine atoms attached to a pyridazine, pyrimidine or symtriazine ring. One preferred type of cyanuric halide reagent contains an aromatic ring having two reactive halide functional groups attached thereto.

(Formula I)

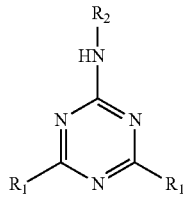

where $R_1$ equals F, Cl, Br, or I and $R_2$ equals $(CH_2)_n$—OH (n=1-3), $(CH_2)_n$—COOH (n=1-3), $C_6H_5$—COOH, or $HSO_3X$ where X equals $(CH_2)_n$ (n=1-3) or $C_6H_4$.

In a particularly preferred embodiment the water soluble cyanuric halide is a dichlorotrizines having the formula:

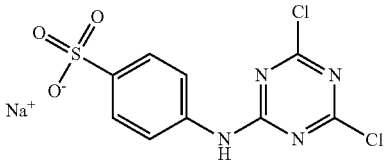

In other embodiments the present invention provides a method of increasing the bulk of a tissue web comprising the steps of preparing a treated fiber by reacting cellulosic fiber with a cellulosic reactive reagent selected from the group consisting of a cellulosic reactive compound having the Formula (II) and salts thereof:

(Formula II)

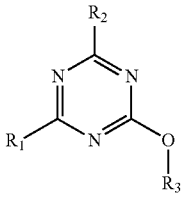

where $R_1$ and $R_2$ equal halogen, such as Cl, a quaternary ammonium group or an activated alkene and $R_3$ equals hydrogen or a metal cation, such as a sodium cation. Suitable quaternary ammonium groups include, for example, 4-m-carboxypyridinium and pyridinium. Suitable activated alkenes include, for example, alkenes having the general formula —NH—$C_6H_4$—$SO_2CH_2CH_2L$, where L is a leaving group selected from the group consisting of a halogen, —$OSO_3H$, —$SSO_3H$, —$OPO_3H$ and salts thereof.

In still other embodiments the treated fiber may be created by reacting cellulosic fiber with a vinyl sulfone having the general Formula (III):

(Formula III)

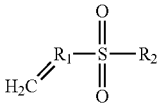

where $R_1$ equals a hydrocarbon having from about 1 to about 5 carbon atoms and $R_2$ equals $CH_3$, HC═$CH_2$, $(CH_2)_n$—$CH_3$ (n=1-3), $(CH_2)_n$—COOH (n=1-3), $C_6H_4$—COOH, or $C_6H_5$.

In yet other embodiments the treated fiber may be created by reacting cellulosic fiber with water soluble cellulosic reactive compound having the general Formula (IV):

(Formula IV)

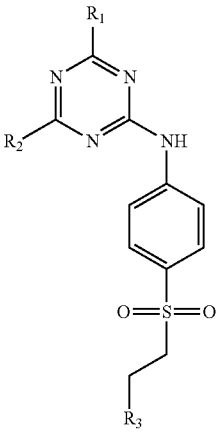

where $R_1$ equals F, Cl, Br, I or —OH, $R_2$ equals F, Cl, Br, I or —OH and $R_3$ equals —$OSO_3$— and salts thereof, —$SSO_3$— and salts thereof, phosphoric acid and salts thereof, or a halide.

Preferably the cellulosic reactive reagents have a water solubility of greater than about 5 mg/mL and more preferably greater than about 10 mg/mL and still more preferably greater than about 100 mg/mL, when measured at 60° C. The water solubility of the reagent provides the advantage of simplifying the modification process, reducing costs and improving reaction yields of treated fibers.

Reaction with a water soluble reagent, compared to a water insoluble reagent such as 2,4,6-trichlorotriazine, provides the additional benefit of reducing the degree of crosslinking between cellulosic fibers. For example, 2-(4,6-dichloro-(1,3,5)-triazine-2 aminoyl)ethanesulfonic acid is less reactive with cellulosic fibers than 2,4,6-trichlorotriazine because the most reactive chloride group has been substituted with amino ethane sulfonic acid to increase water solubility. The reduced reactivity and reduced number of halide functional groups results in less fiber crosslinking, which yields a treated fiber that is less stiff and more susceptible to processing, such as by refining.

Any suitable process may be used to generate or place the cellulosic reactive reagents on the cellulosic fibers, which is generally referred to herein as "modification." Possible modification processes include any synthetic method(s) which may be used to associate the cellulosic reactive reagent with the cellulosic fibers. More generally, the modification step may use any process or combination of processes which promote or cause the generation of a modified cellulosic fiber. For example, in certain embodiments the cellulosic fiber is first reacted with a cellulosic reactive reagent followed by alkaline treatment and then washing to remove excess alkali and unreacted reagent. In addition to alkali treatment, the cellulosic fiber may also be subjected to swelling. Alkali treatment and swelling may be provided by separate agents, or the same agent.

In a particularly preferred embodiment modification is carried out by alkali treatment to generate anionic groups, such as carboxyl, sulfate, sulfonate, phosphonate, and/or phosphate on the cellulosic fiber. Alkali treatment may be carried out before, after or coincidental to reaction with the cellulosic reactive reagent. Anionic groups are preferably generated under alkaline conditions, which in a preferred embodiment, is obtained by using sodium hydroxide. In other embodiments the alkaline agent is selected from hydroxide salts, carbonate salts and alkaline phosphate salts. In still other embodiments the alkaline agent may be selected from alkali metal or alkaline earth metal oxides or hydroxides; alkali silicates; alkali aluminates; alkali carbonates; amines, including aliphatic hydrocarbon amines, especially tertiary amines; ammonium hydroxide; tetramethyl ammonium hydroxide; lithium chloride; N-methyl morpholine N-oxide; and the like.

In addition to the generation of anionic groups by the addition of an alkaline agent, swelling agents may be added to increase access for modification. Interfibrillar and intercrystalline swelling agents are preferred, particularly swelling agents used at levels which give interfibrillar swelling, such as sodium hydroxide at an appropriately low concentration to avoid negatively affecting the rheological performance of the fiber.

Either prior to or after alkali treatment, the cellulosic fiber is reacted with a cellulosic reactive reagent to form a treated fiber. The amount of reagent will vary depending on the type of cellulosic fiber, the desired degree of modification and the desired physical properties of the tissue web formed with treated fibers. In certain embodiments the mass ratio of cellulosic fiber to reagent is from about 5:0.05 to about 2:1, more preferably from about 5:0.1 to about 4:1, such that the weight percentage of reagent, based upon the cellulosic fiber is from about 1 to about 50 percent and more preferably from about 2 to about 25 percent.

Further, modification may be carried out at a variety of fiber consistencies. For example, in one embodiment modification is carried out at a fiber consistency greater than about 5 percent solids, more preferably greater than about 10 percent solids, such as from about 10 to about 50 percent solids. In those embodiments where the cellulosic reactive reagent is mixed with the cellulosic fiber prior to alkali treatment it is particularly preferred that modification be carried out at a fiber consistency greater than about 10 percent, such as from about 10 to about 30 percent, so as to limit hydrolysis of the reagent.

Preferably the reaction of reagent and cellulosic fibers is carried out in an aqueous-alkaline solution having a pH value greater than about seven, more preferably greater than nine and more preferably greater than about ten. More preferably the aqueous-alkaline solution does not include an organic solvent and the cellulosic reactive reagent is not dissolved in an organic solvent prior to addition to the aqueous-alkaline solution.

The reaction time and temperature should be sufficient for the degree of modification, measured as the weight percent of nitrogen present in the fiber, where the reagent is a water soluble halide, is at least about 0.05 weight percent, such as from about 0.05 to about 5 weight percent, and more preferably from about 0.1 to about 3 weight percent. Accordingly, in certain embodiments, the treatment according to the invention can be carried at a temperature from about 0 about 100° C., such as from about 20 to about 70° C. In certain embodiments the treatment time at 20° C. may range from about 30 minutes to 24 hours, such as from about 30 minutes to 10 hours, and in a particularly preferred embodiment from about 40 minutes to 5 hours.

As noted previously, the degree of modification may be measured as rate of substitution. In certain embodiments reaction of cellulosic fibers with a cellulose reactive agent results in a rate of substitution from about 0.02 to about 0.07. Degree of modification may also be measured by elemental analysis of the reacted cellulosic fiber. For example, where the cellulosic reactive reagent is a cyanuric halide, the nitrogen content of fiber is increased upon modification. The increase in nitrogen results mainly from the heterocyclically bonded nitrogen of the modified triazine ring, because the nitrogen content for an unmodified cellulose fiber material is very low, generally less than about 0.01 percent. Upon reaction with a water soluble cyanuric halide as described herein, the nitrogen content may be increased to greater than about 0.05 weight percent, and more preferably greater than about 0.1 weight percent, such as from about 0.1 to about 5 and still more preferably from about 0.3 to about 1 weight percent.

Webs that include the treated fibers can be prepared in any one of a variety of methods known in the web-forming art. In a particularly preferred embodiment treated fibers are incorporated into tissue webs formed by through-air drying and can be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

Fibrous tissue webs can generally be formed according to a variety of papermaking processes known in the art. For example, wet-pressed tissue webs may be prepared using methods known in the art and commonly referred to as couch forming, wherein two wet web layers are independently formed and thereafter combined into a unitary web. To form the first web layer, fibers are prepared in a manner well known in the papermaking arts and delivered to the first stock chest, in which the fiber is kept in an aqueous suspension. A stock pump supplies the required amount of suspension to the suction side of the fan pump. Additional dilution water also is mixed with the fiber suspension.

To form the second web layer, fibers are prepared in a manner well known in the papermaking arts and delivered to the second stock chest, in which the fiber is kept in an aqueous suspension. A stock pump supplies the required amount of suspension to the suction side of the fan pump. Additional dilution water is also mixed with the fiber suspension. The entire mixture is then pressurized and delivered to a headbox. The aqueous suspension leaves the headbox and is deposited onto an endless papermaking fabric over the suction box. The suction box is under vacuum which draws water out of the suspension, thus forming the second wet web. In this example, the stock issuing from the headbox is referred to as the "dryer side" layer as that layer will be in eventual contact with the dryer surface. In some embodiments, it may be desired for a layer containing the treated cellulosic fibers and pulp fiber blend to be formed as the "dryer side" layer.

After initial formation of the first and second wet web layers, the two web layers are brought together in contacting relationship (couched) while at a consistency of from about 10 to about 30 percent. Whatever consistency is selected, it is typically desired that the consistencies of the two wet webs be substantially the same. Couching is achieved by bringing the first wet web layer into contact with the second wet web layer at roll.

After the consolidated web has been transferred to the felt at the vacuum box, dewatering, drying and creping of the consolidated web is achieved in the conventional manner. More specifically, the couched web is further dewatered and transferred to a dryer (e.g., Yankee dryer) using a pressure roll, which serves to express water from the web, which is absorbed by the felt, and causes the web to adhere to the surface of the dryer.

The wet web is applied to the surface of the dryer by a press roll with an application force of, in one embodiment, about 200 pounds per square inch (psi). Following the pressing or dewatering step, the consistency of the web is typically at or above about 30 percent. Sufficient Yankee dryer steam power and hood drying capability are applied to this web to reach a final consistency of about 95 percent or greater, and particularly 97 percent or greater. The sheet or web temperature immediately preceding the creping blade, as measured, for example, by an infrared temperature sensor, is typically about 250° F. or higher. Besides using a Yankee dryer, it should also be understood that other drying methods, such as microwave or infrared heating methods, may be used in the present invention, either alone or in conjunction with a Yankee dryer.

At the Yankee dryer, the creping chemicals are continuously applied on top of the existing adhesive in the form of an aqueous solution. The solution is applied by any convenient means, such as using a spray boom that evenly sprays the surface of the dryer with the creping adhesive solution. The point of application on the surface of the dryer is immediately following the creping doctor blade, permitting sufficient time for the spreading and drying of the film of fresh adhesive.

The creping composition may comprise a non-fibrous olefin polymer, as disclosed in U.S. Pat. No. 7,883,604, the contents of which are hereby incorporated by reference in a manner consistent with the present disclosure, which may be applied to the surface of the Yankee dryer as a water insoluble dispersion that modifies the surface of the tissue web with a thin, discontinuous polyolefin film. In particularly preferred embodiments the creping composition may comprise a film-forming composition and an olefin polymer comprising an interpolymer of ethylene and at least one comonomer comprising an alkene, such as 1-octene. The creping composition may also contain a dispersing agent, such as a carboxylic acid. Examples of particular dispersing agents, for instance, include fatty acids, such as oleic acid or stearic acid.

In one particular embodiment, the creping composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

The olefin polymer composition may exhibit a crystallinity of less than about 50 percent, such as less than about 20 percent. The olefin polymer may also have a melt index of less than about 1000 g/10 min, such as less than about 700 g/10 min. The olefin polymer may also have a relatively small particle size, such as from about 0.1 to about 5 microns when contained in an aqueous dispersion.

In an alternative embodiment, the creping composition may contain an ethylene-acrylic acid copolymer. The ethylene-acrylic acid copolymer may be present in the creping composition in combination with a dispersing agent.

The basis weight of tissue webs made in accordance with the present disclosure can vary depending upon the final product. For example, the process may be used to produce bath tissues, facial tissues, paper towels, and the like. In general, the basis weight of the tissue web may vary from about 5 to about 50 gsm, such as from about 10 to about 40 gsm. Tissue webs may be converted into single and multi-ply bath or facial tissue products having basis weight from about 10 to about 80 gsm and more preferably from about 20 to about 50 gsm.

In addition to having sufficient strength to withstand use and relatively low stiffness, the tissue webs and products of the present disclosure also have good bulk characteristics, regardless of the method of manufacture. For instance, conventional creped wet pressed tissue products prepared using treated fibers may have a sheet bulk greater than about 8 cc/g, such as from about 8 to about 15 cc/g and more preferably from about 10 to 12 cc/g. In other embodiments through-air dried tissue and more preferably uncreped through-air dried tissue comprising treated fibers have a sheet bulk greater than about 10 cc/g, such as from about 10 to about 25 cc/g and more preferably from about 16 to about 22 cc/g.

The increase in bulk is particularly acute when the treated fiber is disposed in the center layer of a three layer structure. Surprisingly, the increase in bulk is accompanied by minimal degradation in strength and a decrease in the Stiffness Index. A comparison of various tissue webs illustrating this effect are shown in the table below.

TABLE 2

| Sample | Treated Fiber (Wt. % Total Product) | Bulk (cc/g) | Delta Bulk (%) | GMT (g/3") | Delta GMT (%) | Stiffness Index | Delta Stiffness Index (%) |
|---|---|---|---|---|---|---|---|
| Control | — | 5.85 | — | 756 | — | 17.58 | — |
| Outer Layers | 35% | 8.95 | 53 | 586 | −22 | 10.94 | −38 |
| Middle Layer | 30% | 9.52 | 63 | 775 | 3 | 10.01 | −43 |

Accordingly, in certain preferred embodiments the present disclosure provides a tissue web having enhanced bulk and softness without a significant decrease in tensile, where the web has three layers—a first, a second and a third layer, wherein treated fibers are selectively disposed in the second layer and comprise from about 5 to about 50 percent, and more preferably from about 10 to about 30 percent of the weight of the web. In a particularly preferred embodiment the present disclosure provides a two-ply tissue product where each tissue ply comprises three layers and treated fibers selectively disposed in the middle layer, the tissue product having a GMT from about 600 to about 800 g/3", a sheet bulk greater than about 8 cc/g, such as from about 8 to about 12 cc/g and a Stiffness Index less than about 15, such as from about 8 to about 12.

In other embodiments the present disclosure provides a two-ply tissue product comprising an upper multi-layered tissue web and a lower multi-layered tissue web that are plied together using well-known techniques. The multi-layered webs comprise at least a first and a second layer, wherein treated fibers are selectively incorporated in only one of the layers, such that when the webs are plied together the layers containing the treated fibers are brought into contact with the user's skin in-use. For example, the two-ply tissue product may comprise a first and second tissue web, wherein the tissue webs each comprise a first and second layer. The first layer of each tissue web comprises wood fibers and treated fibers and, while the second layer of each tissue web is substantially free of treated fibers. When the tissue webs are plied together to form the tissue product the second layers of each web are arranged in a facing relationship such that the treated fibers are brought into contact with the user's skin in-use.

In other embodiments, tissue products produced according to the present disclosure have GMT greater than about 500 g/3", such as from about 500 to about 900 g/3" and more preferably from about 600 to about 750 g/3". At these strengths, the tissue products generally have GM Slopes less than about 10 kg/3", such as from about 5 to about 9 kg/3", and in particularly preferred embodiments from about 6 to about 8 kg/3". The relatively slow GM Slope and modest GMT yield products having relatively low Stiffness Index, such as less than about 15, for example from about 8 to about 15 and in particularly preferred embodiments from about 10 to about 12.

Test Methods

Sheet Bulk

Sheet Bulk is calculated as the quotient of the dry sheet caliper expressed in microns, divided by the bone dry basis weight, expressed in grams per square meter (gsm). The resulting Sheet Bulk is expressed in cubic centimeters per gram. More specifically, the Sheet Bulk is the representative caliper of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board." The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm). The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm*cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

EXAMPLES

Modified wood pulps were prepared by mixing about 140 kg of eucalyptus kraft pulp with about 140 kg of Rayosan™ C Pa (Clariant International AG), water-soluble dichlorotrizine having the formula below, and 28 kg of a 30 percent solution of NaOH.

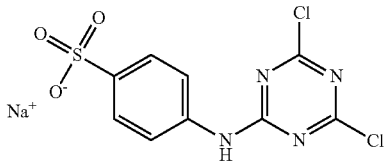

The consistency of the reaction mixture was about 16 percent. The reaction mixture was stored for about 12 hours at about 20° C. and then the pulp was washed three times with water and diluted to a final consistency of about 2 percent to yield modified eucalyptus kraft pulp (MEKP).

The modified eucalyptus kraft pulp was used to produce tissue products utilizing a conventional wet pressed tissue-making process on a pilot scale tissue machine. Several different tissue products were formed to assess the effect of MEKP on tissue properties. The tissue products comprised a variety of different furnishes split between the various layers of a three layered web. The furnish composition and distribution of the various tissue products is summarized in Table 3, below.

The northern softwood kraft (NSWK) furnish was prepared by dispersing NSWK pulp in a pulper for 30 minutes at about 4 percent consistency at about 100° F. The NSWK pulp was refined at 1.5 hp-days/metric ton as set forth in Table 3, below. The NSWK pulp was then transferred to a dump chest and subsequently diluted with water to approximately 2 percent consistency. Softwood fibers were then pumped to a machine chest. In certain instances wet strength resin (Kymene™ 920A, Ashland, Inc., Covington, Ky.) was added to the NSWK pulp as it was metered from the machine chest to the tissue machine.

Eucalyptus hardwood kraft (EHWK) pulp was dispersed in a pulper for 30 minutes at about 4 percent consistency at about 100° F. The EHWK pulp was then transferred to a dump chest and diluted to about 2 percent consistency. The EHWK pulp was then pumped to a machine chest. In certain instances wet strength resin (Kymene™ 920A, Ashland, Inc., Covington, Ky.) was added to the EHWK pulp as it was metered from the machine chest to the tissue machine.

Modified eucalyptus kraft pulp (MEKP) prepared as described above was dispersed in a pulper for 30 minutes at about 4 percent consistency at about 100° F. The MEKP was then transferred to a dump chest and diluted to about 2 percent consistency. The MEKP was then pumped to a machine chest. In certain instances wet strength resin (Kymene™ 920A, Ashland, Inc., Covington, Ky.) was added to the MEKP pulp as it was metered from the machine chest to the tissue machine.

TABLE 3

| Sample | Wet Strength Resin (kg/MT) | Wet Strength Layer | Refining (min.) | Felt Layer (wt %) | Center Layer (wt %) | Dryer Layer (wt %) |
|---|---|---|---|---|---|---|
| 1 | 2 | All layers | 7 | EHWK (35%) | NSWK (30%) | EHWK (35%) |
| 2 | 2 | All layers | 11 | NSWK (35%) | MEKP (30%) | EHWK (35%) |
| 3 | 2 | All layers | 11 | EHWK (17.5%) MEKP (17.5%) | NSWK (30%) | EHWK (17.5%) MEKP (17.5%) |
| 4 | 2 | All layers | 11 | MEKP (35%) | NSWK (30%) | MEKP (35%) |

The pulp fibers from the machine chests were pumped to the headbox at a consistency of about 0.1 percent. Pulp fibers from each machine chest were sent through separate manifolds in the headbox to create a 3-layered tissue structure. The fibers were deposited onto a felt using a Crescent Former.

The consistency of the wet sheet after the pressure roll nip (post-pressure roll consistency or PPRC) was approximately 40 percent. A spray boom situated underneath the Yankee dryer sprayed a creping composition at a pressure of 60 psi at a rate of approximately 0.25 g solids/$m^2$ of product. The creping composition comprised 0.16 percent by weight of polyvinyl alcohol (PVOH), (Celvol™ 523 available from Celanese Chemicals, Calvert City, Ky.), 0.013 percent by weight PAE resin (Kymene™ 6500 available from Ashland, Covington, Ky.) and 0.0013 percent by weight of Resozol™ 2008 (Ashland, Covington, Ky.).

The sheet was dried to about 98 to 99 percent consistency as it traveled on the Yankee dryer and to the creping blade. The creping blade subsequently scraped the tissue sheet and a portion of the creping composition off the Yankee dryer. The creped tissue basesheet was then wound onto a core traveling at about 50 to about 100 fpm into soft rolls for converting.

To produce the 2-ply facial tissue products (Sample Nos. 1-4), two soft rolls of the creped tissue were then rewound, calendered, and plied together so that both creped sides were on the outside of the 2-ply structure. Mechanical crimping on the edges of the structure held the plies together. The plied sheet was then slit on the edges to a standard width of approximately 8.5 inches and folded, and cut to facial tissue length. Tissue samples were conditioned and tested. The results of the testing are summarized in Table 4, below.

TABLE 4

| Sample | BW (gsm) | Caliper (μm) | Bulk (cc/g) | Delta Bulk | GMT (g/3") | GM Slope (kg/3") | Stiffness Index | Delta Stiffness Index |
|---|---|---|---|---|---|---|---|---|
| 1 | 30.27 | 177 | 5.85 | — | 756 | 13.29 | 17.58 | — |
| 2 | 29.73 | 283 | 9.52 | 63% | 775 | 7.76 | 10.01 | −43% |
| 3 | 28.49 | 255 | 8.95 | 53% | 586 | 6.41 | 10.94 | −38% |
| 4 | 29.52 | 330 | 11.18 | 91% | 451 | 5.14 | 11.4 | −35% |

We claim:

1. A creped wet pressed tissue product comprising at least one multi-layered creped tissue web having a first fibrous layer, a second fibrous layer, and a third layer fibrous layer, the first and third fibrous layers comprising untreated cellulosic fibers and substantially free from treated cellulosic fibers and the second fibrous layer comprising at least about 5 percent, by weight of the layer, cellulosic fibers reacted with a cellulosic reactive reagent selected from the group consisting of reagents having the general Formula (I), (II), (III) and (IV), the tissue product having a basis weight from about 10 to about 60 grams per square meter (gsm), a geometric mean tensile (GMT) from about 500 to about 800 g/3 inches, a sheet bulk greater than about 8 cc/g and a Stiffness Index less than about 15.

2. The tissue product of claim 1 wherein the multi-layered tissue web comprises a creped tissue web and the tissue product has a basis weight from about 14 to about 20 gsm.

3. The tissue product of claim 1 having and Stiffness Index less than about 12.

4. The tissue product of claim 1 having a sheet bulk from about 8 to about 12 cc/g.

5. The tissue product of claim 1 wherein the treated cellulosic fibers comprise cellulosic fibers reacted with a cellulosic reactive reagent selected from the group consisting of reagents having the general Formula (I), (II) and (IV).

6. The tissue product of claim 1 wherein the treated cellulosic fiber has a nitrogen content of at least about 0.2 weight percent.

7. The tissue product of claim 1 wherein the treated fibers comprise from about 10 to about 50 percent of the total weight of the multi-layered web.

8. The tissue product of claim 1 wherein the tissue product comprises two creped multi-layered webs, the tissue product having a basis weight from about 28 to about 34 gsm, a sheet bulk from about 9 to about 12 cc/g, a GMT from about 500 to about 800 g/3" and a Stiffness Index from about 8 to about 12.

9. A method of forming a tissue product comprising the steps of:

a. treating cellulosic fiber with a caustic agent;

b. reacting the cellulosic fiber with a cellulosic reactive reagent selected from the group consisting of regents having the general Formula (I), (II), (III) and (IV) to yield a treated cellulosic fiber;

c. washing the treated cellulosic fiber;

d. forming a multi-layered tissue web by depositing the treated cellulosic fiber between adjacent layers of untreated cellulosic fiber; and e. combining two or more multi-layered tissue webs to form a tissue product, wherein the sheet bulk of the web is at least 8 cc/g and the sheet bulk is at least about 50 percent greater than a comparable tissue product substantially free of treated fibers.

10. The method of claim 9 further comprising the step of creping the multi-layered tissue web.

11. The method of claim 9 wherein the tissue product has a basis weight from about 28 to about 34 grams per square meter (gsm).

12. The method of claim 9 wherein the tissue product has a geometric mean tensile (GMT) from about 500 to about 800 g/3 inches and Stiffness index less than about 12.

13. The method of claim 9 wherein the tissue product has a basis weight from about 28 to about 34 gsm, a sheet bulk from about 10 to about 12 cc/g, a GMT from about 500 to about 800 g/3 inches and a Stiffness Index from about 8 to about 12.

14. A multi-ply tissue product having increased sheet bulk comprising at least one creped wet pressed multi-layered tissue web comprising a first and a second fibrous layer, wherein the first layer is substantially free from treated cellulosic fibers and the second fibrous layer comprises at least about 5 percent, by weight of the web, treated fibers comprising cellulosic fibers reacted with a cellulosic reactive reagent selected from the group consisting of reagents having the general Formula (I), (II), (III) and (IV), wherein the sheet bulk of the web is at least 8 cc/g and the sheet bulk is at least about 50 percent greater than a comparable tissue product substantially free of treated fibers.

15. The multi-ply tissue product of claim 14 wherein the tissue product has a basis weight from about 10 to about 50 grams per square meter (gsm).

16. The multi-layered tissue product of claim 14 having a geometric mean tensile (GMT) from about 500 to about 800 g/3 inches and Stiffness index less than about 12.

17. The multi-layered tissue product of claim 14 having a sheet bulk greater than about 10 cc/g.

18. The multi-ply tissue product of claim 14 wherein the treated cellulosic fiber has a nitrogen content of at least about 0.2 weight percent.

19. The multi-ply tissue product of claim 14 wherein the treated fibers comprise from about 10 to about 50 percent of the total weight of the multi-layered web.

20. The multi-ply tissue product of claim 14 having a basis weight from about 28 to about 34 gsm, a sheet bulk from about 8 to about 12 cc/g, a GMT from about 500 to about 800 g/3 inches and a Stiffness Index from about 8 to about 12.

* * * * *